US010102966B2

(12) United States Patent
Kitagawa et al.

(10) Patent No.: US 10,102,966 B2
(45) Date of Patent: Oct. 16, 2018

(54) STATIONARY INDUCTION APPARATUS

(71) Applicant: MITSUBISHI ELECTRIC CORPORATION, Chiyoda-ku, Tokyo (JP)

(72) Inventors: Yoshinobu Kitagawa, Tokyo (JP); Takamaru Yokomaku, Tokyo (JP); Ryuichi Nishiura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/533,821

(22) PCT Filed: Dec. 8, 2014

(86) PCT No.: PCT/JP2014/082410
§ 371 (c)(1),
(2) Date: Jun. 7, 2017

(87) PCT Pub. No.: WO2016/092612
PCT Pub. Date: Jun. 16, 2016

(65) Prior Publication Data

US 2017/0330681 A1 Nov. 16, 2017

(51) Int. Cl.
*H01F 27/32* (2006.01)
*H01F 27/36* (2006.01)
(Continued)

(52) U.S. Cl.
CPC ..... *H01F 27/365* (2013.01); *H01F 27/245* (2013.01); *H01F 27/32* (2013.01); *H01F 2027/348* (2013.01)

(58) Field of Classification Search
CPC ..... H01F 27/00–27/36
(Continued)

(56) References Cited

U.S. PATENT DOCUMENTS 1,610,867 A * 12/1926 Lennox ..... H01F 27/365 336/183
2,370,045 A * 2/1945 Keto ..... H01F 27/365 336/176
(Continued)

FOREIGN PATENT DOCUMENTS

JP 60-125719 U 8/1985
JP 2011/23630 A 2/2011
(Continued)

OTHER PUBLICATIONS

International Search Report (PCT/ISA/210) dated Mar. 3, 2015, by the Japanese Patent Office as the International Searching Authority for International Application No. PCT/JP2014/082410.
(Continued)

*Primary Examiner* — Tuyen Nguyen
(74) *Attorney, Agent, or Firm* — Buchanan Ingersoll & Rooney PC

(57) ABSTRACT

A stationary induction apparatus includes: an iron core with a shaft portion including a plurality of first electromagnetic steel plates stacked in a stacking direction, the shaft portion having a main surface located at each of both ends of the plurality of first electromagnetic steel plates in the stacking direction; a winding wound around the shaft portion; a first magnetic shield arranged along the main surface, the first magnetic shield being configured by stacking a plurality of second electromagnetic steel plates in a direction orthogonal to the stacking direction of the first electromagnetic steel plates; and a second magnetic shield arranged along the main surface, the second magnetic shield being arranged on each of both sides of the first magnetic shield, the second magnetic shield being configured by stacking a plurality of third electromagnetic steel plates in a direction orthogonal to
(Continued)

the stacking direction of the second electromagnetic steel plates.

4 Claims, 5 Drawing Sheets

(51) Int. Cl.
*H01F 27/245* (2006.01)
*H01F 27/34* (2006.01)

(58) Field of Classification Search
USPC ..... 336/84 F, 84 C, 84 M, 212, 233–234
See application file for complete search history.

(56) References Cited

U.S. PATENT DOCUMENTS 3,464,041 A * 8/1969 Waterman ..... H01F 27/365 336/178
3,577,109 A * 5/1971 Foster ..... H01F 27/245 336/212
6,429,765 B1 * 8/2002 Valdemarsson ..... H01F 29/14 336/212
2012/0299686 A1 11/2012 Matsuda et al.

FOREIGN PATENT DOCUMENTS

JP 2012/222332 A 11/2012
JP 2012-230957 A 11/2012
WO WO 2011/111257 A1 9/2011

OTHER PUBLICATIONS

Notice of Grounds of Rejection dated Aug. 4, 2015 for Patent Application No. 2015-526429 and English translation.

* cited by examiner

STATIONARY INDUCTION APPARATUS

TECHNICAL FIELD

The present invention relates to a stationary induction apparatus, and particularly to a stationary induction apparatus such as a transformer and a reactor.

BACKGROUND ART

Japanese Patent Laying-Open No. 2012-222332 (PTD 1) is cited as a prior art literature that discloses a magnetic shield of a stationary induction apparatus. The magnetic shield of the stationary induction apparatus disclosed in Japanese Patent Laying-Open No. 2012-222332 (PTD 1) is arranged between a winding and an iron core. The magnetic shield includes a plurality of electromagnetic steel plates extending in the axis direction of the winding and stacked in the direction orthogonal to this axis direction.

CITATION LIST

Patent Document

PTD 1: Japanese Patent Laying-Open No. 2012-222332

SUMMARY OF INVENTION

Technical Problem

A plurality of electromagnetic steel plates extending in the axis direction of the winding are stacked in the direction orthogonal to the axis direction of the winding, thereby forming a magnetic shield, which is then arranged between the winding and the iron core. In such a state, an eddy current is generated by entry of a leakage flux from the winding through the main surface of an electromagnetic steel plate that is located at each of both ends of the magnetic shield in the stacking direction of the electromagnetic steel plates. Consequently, eddy current loss occurs in the magnetic shield.

The present invention has been made in light of the above-described problems. An object of the present invention is to provide a stationary induction apparatus that is improved in efficiency by reducing the eddy current loss occurring in the magnetic shield arranged between the winding and the iron core.

Solution to Problem

A stationary induction apparatus according to the present invention includes: an iron core provided with a shaft portion including a plurality of first electromagnetic steel plates that are stacked in a stacking direction, the shaft portion having a main surface located at each of both ends of the plurality of first electromagnetic steel plates in the stacking direction; a winding wound around the shaft portion; a first magnetic shield arranged along the main surface at least between the shaft portion and the winding, the first magnetic shield being configured by stacking a plurality of second electromagnetic steel plates in a direction orthogonal to the stacking direction of the first electromagnetic steel plates, the plurality of second electromagnetic steel plates extending in an axis direction of the shaft portion; and a second magnetic shield arranged along the main surface at least between the shaft portion and the winding, the second magnetic shield being arranged on each of both sides of the first magnetic shield so as to sandwich the first magnetic shield in a stacking direction of the second electromagnetic steel plates, the second magnetic shield being configured by stacking a plurality of third electromagnetic steel plates in a direction orthogonal to the stacking direction of the second electromagnetic steel plates, the plurality of third electromagnetic steel plates extending in the axis direction of the shaft portion.

Advantageous Effects of Invention

According to the present invention, the eddy current loss in the magnetic shield arranged between the winding and the iron core is reduced, so that the efficiency of the stationary induction apparatus can be improved.

DESCRIPTION OF EMBODIMENTS

Figure 1:
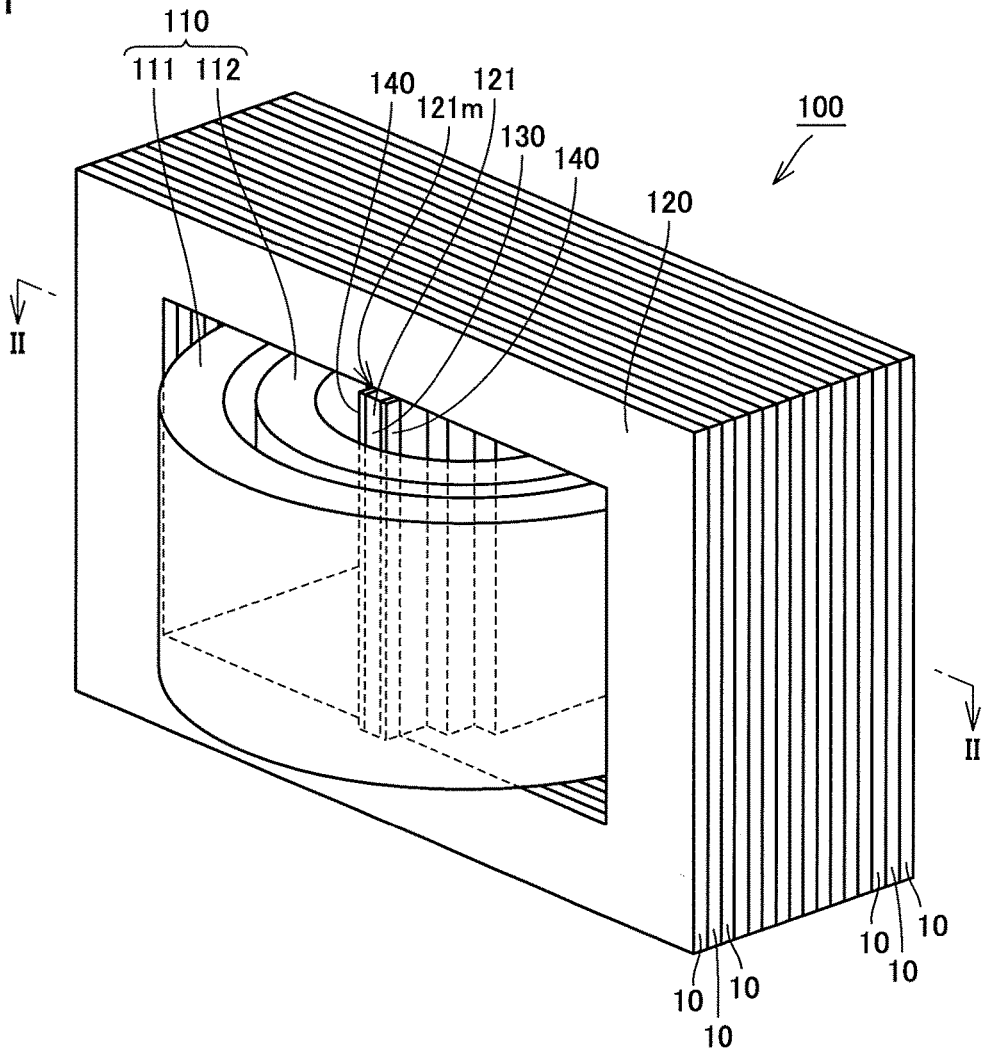
FIG. 1 is a perspective view showing the configuration of a stationary induction apparatus according to the first embodiment of the present invention.

In the following, a stationary induction apparatus according to each embodiment of the present invention will be described with reference to the accompanying drawings. In the following description of each embodiment, the same or corresponding components in the drawings are designated by the same reference characters, and a description thereof will not be repeated. A transformer, a reactor and the like are included as a stationary induction apparatus.

First Embodiment

Figure 2:
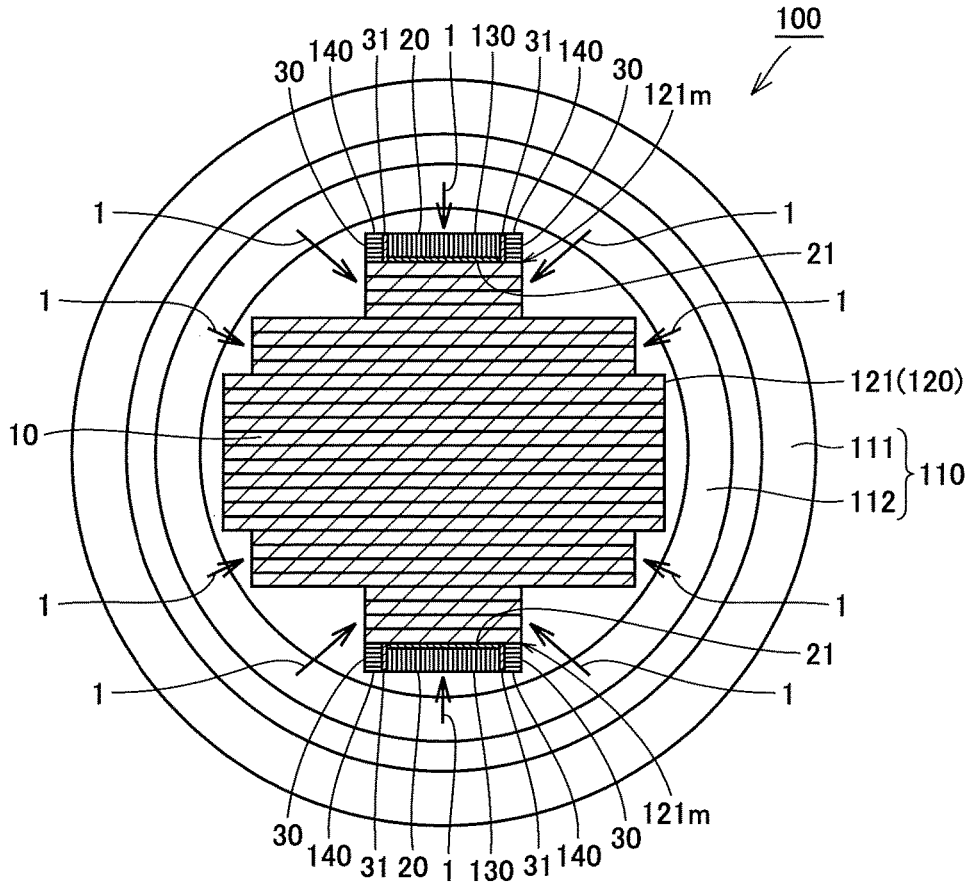
FIG. 2 is a cross-sectional view of the stationary induction apparatus in FIG. 1 taken along a line II-II and seen in an arrow direction.

FIG. 1 is a perspective view showing the configuration of a stationary induction apparatus according to the first embodiment of the present invention. FIG. 2 is a cross-sectional view of the stationary induction apparatus in FIG. 1 taken along a line II-II and seen in an arrow direction. As shown in FIGS. 1 and 2, a stationary induction apparatus 100 according to the first embodiment of the present invention is a core-type transformer. Stationary induction apparatus 100 includes a winding 110, an iron core 120, a first magnetic shield 130, and a second magnetic shield 140.

Iron core 120 includes a plurality of first electromagnetic steel plates 10 stacked in one direction. In iron core 120, a shaft portion 121 is formed that has a main surface 121*m* located at each of both ends of the plurality of first electromagnetic steel plates 10 in the stacking direction. Iron core 120 is a three leg core. Shaft portion 121 serves as a leg portion located in the center of three leg portions.

In the present embodiment, shaft portion 121 has a width that reduces in a stepwise manner toward winding 110 in the stacking direction of first electromagnetic steel plates 10. It is to be noted that the width of shaft portion 121 corresponds to a distance from one end to the other end of shaft portion 121 in the direction that is orthogonal to each of the stacking direction of first electromagnetic steel plates 10 and the axis direction of shaft portion 121. However, the shape of shaft portion 121 is not limited to the above, but may be a rectangular shape in a cross section.

Winding 110 is wound around shaft portion 121. Winding 110 includes a high-voltage coil 111 and a low-voltage coil 112 that are arranged coaxially about shaft portion 121 as a common central axis. Low-voltage coil 112 is located on the outside of shaft portion 121 so as to surround shaft portion 121. High-voltage coil 111 is located on the outside of low-voltage coil 112 so as to surround low-voltage coil 112.

First magnetic shield 130 is configured by stacking a plurality of second electromagnetic steel plates 20, which extend in the axis direction of shaft portion 121, in the direction orthogonal to the stacking direction of first electromagnetic steel plates 10. First magnetic shield 130 is arranged along main surface 121*m* between shaft portion 121 and winding 110. The position of first magnetic shield 130 relative to winding 110 and iron core 120 is fixed by a spacer such as a pressboard that is not shown.

In the present embodiment, each of the plurality of second electromagnetic steel plates 20 has a strip shape and has an insulating layer formed on each of its both main surfaces. The plurality of second electromagnetic steel plates 20 are welded and fixed onto retaining plate 21 in the state where these second electromagnetic steel plates 20 are sandwiched on both sides in the stacking direction thereof. Thereby, first magnetic shield 130 is integrally held.

Retaining plate 21 is formed of non-magnetic metal and located perpendicular to each of the plurality of second electromagnetic steel plates 20. Retaining plate 21 has a length that is approximately equal to the length of each of the plurality of second electromagnetic steel plates 20. Retaining plate 21 also has a width that is approximately equal to the total thickness of the plurality of second electromagnetic steel plates 20 that form first magnetic shield 130. Retaining plate 21 is in contact with main surface 121*m* of shaft portion 121. In addition, the length of retaining plate 21 may be shorter than the length of each of the plurality of second electromagnetic steel plates 20.

As shown in FIG. 1, in the present embodiment, first magnetic shield 130 is longer than the width of winding 110 in the axis direction of shaft portion 121, and thus, protrudes to the outside beyond each of both ends of winding 110 in the axis direction of shaft portion 121.

It is to be noted that the length of first magnetic shield 130 is not limited to the above, but may be equal to the width of winding 110 in the axis direction of shaft portion 121. In this case, first magnetic shield 130 is arranged in a region sandwiched between main surface 121*m* of shaft portion 121 and the inner circumferential surface of winding 110 (low-voltage coil 112). In this way, first magnetic shield 130 may be arranged along main surface 121*m* of shaft portion 121 at least between shaft portion 121 and winding 110.

Second magnetic shield 140 is configured by stacking a plurality of third electromagnetic steel plates 30, which extend in the axis direction of shaft portion 121, in the direction orthogonal to the stacking direction of second electromagnetic steel plates 20. Second magnetic shield 140 is arranged along main surface 121*m* of shaft portion 121 between shaft portion 121 and winding 110, and also arranged on each of both sides of first magnetic shield 130 so as to sandwich first magnetic shield 130 in the stacking direction of second electromagnetic steel plates 20. The position of second magnetic shield 140 relative to winding 110 and iron core 120 is fixed by a spacer such as a pressboard that is not shown.

In the present embodiment, each of the plurality of third electromagnetic steel plates 30 has a strip shape and has an insulating layer formed on each of its both main surfaces. The plurality of third electromagnetic steel plates 30 are welded and fixed onto a retaining plate 31 in the state where these third electromagnetic steel plates 30 are sandwiched on both sides in the stacking direction thereof. Thereby, second magnetic shield 140 is integrally held.

Retaining plate 31 is formed of non-magnetic metal and located perpendicular to each of the plurality of third electromagnetic steel plates 30. Retaining plate 31 has a length that is approximately equal to the length of each of the plurality of third electromagnetic steel plates 30. Retaining plate 31 also has a width that is approximately equal to the total thickness of the plurality of third electromagnetic steel plates 30 that form second magnetic shield 140. Retaining plate 31 is in contact with the side surface of first magnetic shield 130 in the stacking direction of second electromagnetic steel plates 20. In addition, the length of retaining plate 31 may be shorter than the length of each of the plurality of third electromagnetic steel plates 30.

It is preferable that the length of second magnetic shield 140 is equal to the length of first magnetic shield 130. It is preferable that the width of second magnetic shield 140 in the stacking direction of third electromagnetic steel plates 30 is equal to the thickness of first magnetic shield 130. In this case, two second magnetic shields 140 can entirely cover each of both side surfaces of first magnetic shield 130 in the stacking direction of second electromagnetic steel plates 20.

It is preferable that first magnetic shield 130 and second magnetic shield 140 entirely cover main surface 121*m* of shaft portion 121. In other words, it is preferable that the total of the width of first magnetic shield 130 and the thickness of two second magnetic shields 140 in the stacking direction of second electromagnetic steel plates 20 is equal to the width of main surface 121*m* of shaft portion 121.

Stationary induction apparatus 100 according to the present embodiment includes first magnetic shield 130 and second magnetic shield 140. Accordingly, as shown in FIG. 2, it becomes possible to suppress entry of a leakage flux 1 from winding 110 in the direction orthogonal to the main surface of first electromagnetic steel plates 10 that form shaft portion 121 of iron core 120. Thereby, occurrence of eddy current loss in shaft portion 121 can be suppressed.

Furthermore, second magnetic shield 140 can suppress entry of leakage flux 1 from winding 110 through the main surface of second electromagnetic steel plate 20 that is located at each of both ends of first magnetic shield 130 in the stacking direction of second electromagnetic steel plates 20. Thereby, occurrence of eddy current loss in first magnetic shield 130 can be suppressed.

In the present embodiment, second magnetic shield 140 entirely covers each of both side surfaces of first magnetic shield 130 in the stacking direction of second electromagnetic steel plates 20. Accordingly, occurrence of eddy current loss in first magnetic shield 130 can be effectively suppressed.

As described above, by reducing the eddy current loss occurring in shaft portion 121 and first magnetic shield 130, the efficiency in stationary induction apparatus 100 can be improved.

Also, in the present embodiment, each of first magnetic shield 130 and second magnetic shield 140 is longer than the width of winding 110 in the axis direction of shaft portion 121, and thus, protrudes to the outside beyond each of both ends of winding 110 in the axis direction of shaft portion 121. Thereby, it becomes possible to suppress entry of leakage flux 1 from winding 110 through the main surface of iron core 120 that is located at each of both ends of shaft portion 121 in the axis direction of shaft portion 121. Thereby, occurrence of eddy current loss in iron core 120 can be further suppressed.

In addition, the space between winding 110 and iron core 120 serves as a flow passage of the cooling medium for cooling winding 110 and iron core 120. By reducing the eddy current loss occurring in iron core 120 and first magnetic shield 130, local heating in iron core 120 and first magnetic shield 130 can be suppressed. Accordingly, the required flow rate of the cooling medium can be reduced, thereby reducing the space between winding 110 and iron core 120, so that the outer diameter of winding 110 can be reduced.

Since the entire length of winding 110 can be shortened by reducing the outer diameter of winding 110, it becomes possible to reduce the manufacturing cost of winding 110 and also reduce the Joule heat loss in winding 110. Also, the outer diameter of winding 110 is reduced, to thereby reduce the size of the tank (not shown), so that stationary induction apparatus 100 can be reduced in size.

In the following, the stationary induction apparatus according to the second embodiment of the present invention will be described. It is to be noted that stationary induction apparatus 200 according to the present embodiment is a shell-type transformer, which is mainly different from the stationary induction apparatus according to the first embodiment. Thus, other configurations will not be repeated.

Second Embodiment

Figure 3:
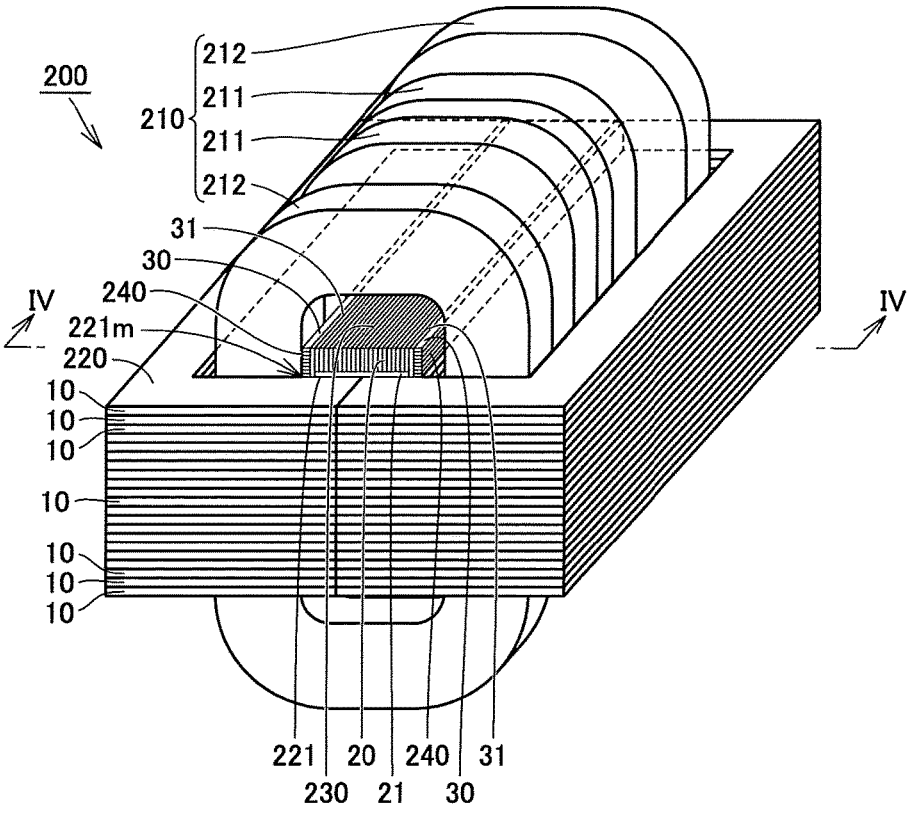
FIG. 3 is a perspective view showing the configuration of a stationary induction apparatus according to the second embodiment of the present invention.
Figure 4:
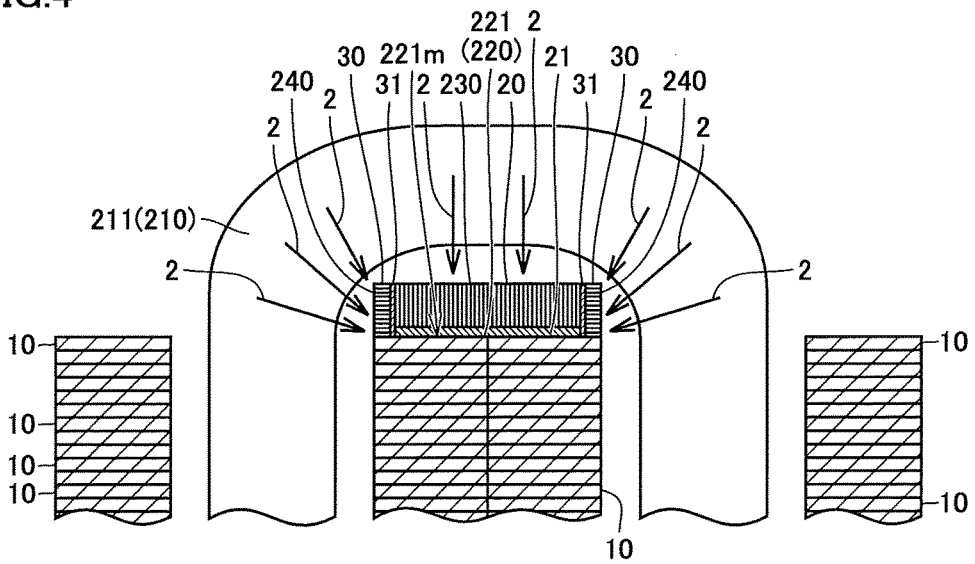
FIG. 4 is a cross-sectional view of the stationary induction apparatus in FIG. 3 taken along a line IV-IV and seen in an arrow direction.

FIG. 3 is a perspective view showing the configuration of a stationary induction apparatus according to the second embodiment of the present invention. FIG. 4 is a cross-sectional view of the stationary induction apparatus in FIG. 3 taken along a line IV-IV and seen in an arrow direction. Although FIG. 3 shows only one side of first electromagnetic steel plates 10 in the stacking direction, first magnetic shield 230 and second magnetic shield 240 are similarly arranged also on the other side of first electromagnetic steel plates 10 in the stacking direction.

As shown in FIGS. 3 and 4, stationary induction apparatus 200 according to the second embodiment of the present invention is a shell-type transformer. Stationary induction apparatus 200 includes a winding 210, an iron core 220, a first magnetic shield 230, and a second magnetic shield 240.

Iron core 220 includes a plurality of first electromagnetic steel plates 10 stacked in one direction. In iron core 220, a shaft portion 221 is formed that has a main surface 221*m* located at each of both ends of the plurality of first electromagnetic steel plates 10 in the stacking direction. Iron core 220 is a three leg core. Shaft portion 221 serves as a leg portion located in the center of three leg portions. In the present embodiment, shaft portion 221 has a rectangular shape in a cross section.

Winding 210 is wound around shaft portion 221. Winding 210 includes a high-voltage coil 211 and a low-voltage coil 212. In the present embodiment, low-voltage coil 212, high-voltage coil 211, high-voltage coil 211, and low-voltage coil 212 are arranged in this order sequentially from the coil closer to the viewer of FIG. 3 so as to extend in the axis direction of shaft portion 221.

First magnetic shield 230 is configured by stacking a plurality of second electromagnetic steel plates 20, which extend in the axis direction of shaft portion 221, in the direction orthogonal to the stacking direction of first electromagnetic steel plates 10. First magnetic shield 230 is arranged along main surface 221*m* between shaft portion 221 and winding 210. The position of first magnetic shield 230 relative to winding 210 and iron core 220 is fixed by a spacer such as a pressboard that is not shown.

In the present embodiment, each of the plurality of second electromagnetic steel plates 20 has a strip shape and has an insulating layer formed on each of its both main surfaces. The plurality of second electromagnetic steel plates 20 are welded and fixed onto retaining plate 21 in the state where these second electromagnetic steel plates 20 are sandwiched on both sides in the stacking direction thereof. Thereby, first magnetic shield 230 is integrally held.

Retaining plate 21 is formed of non-magnetic metal and located perpendicular to each of the plurality of second electromagnetic steel plates 20. Retaining plate 21 has a length that is approximately equal to the length of each of the plurality of second electromagnetic steel plates 20. Retaining plate 21 also has a width that is approximately equal to the total thickness of the plurality of second electromagnetic steel plates 20 that form first magnetic shield 230. Retaining plate 21 is in contact with main surface 221*m* of shaft portion 221. In addition, the length of retaining plate 21 may be shorter than the length of each of the plurality of second electromagnetic steel plates 20.

As shown in FIG. 3, in the present embodiment, first magnetic shield 230 is longer in the axis direction of shaft portion 221 than the length of the region where winding 210 is located (the region extending from low-voltage coil 212 located closer to the viewer of FIG. 3 to low-voltage coil 212 located further from the viewer of FIG. 3). Also, this first magnetic shield 230 protrudes in the axis direction of shaft portion 221 to the outside beyond each of both sides of the region where winding 210 is located.

It is to be noted that the length of first magnetic shield 230 is not limited to the above, but may be equal in the axis direction of shaft portion 221 to the length of the region where winding 210 is located. In this case, first magnetic shield 230 is arranged in the axis direction of shaft portion 221 in the region where winding 210 is located. In this way, first magnetic shield 230 may be arranged along main surface 221*m* of shaft portion 221 at least between shaft portion 221 and winding 210.

Second magnetic shield 240 is configured by stacking a plurality of third electromagnetic steel plates 30, which extend in the axis direction of shaft portion 221, in the direction orthogonal to the stacking direction of second electromagnetic steel plates 20. Second magnetic shield 240 is arranged along main surface 221*m* of shaft portion 221 between shaft portion 221 and winding 210, and also arranged on each of both sides of first magnetic shield 230 so as to sandwich first magnetic shield 230 in the stacking direction of second electromagnetic steel plates 20. The position of second magnetic shield 240 relative to winding 210 and iron core 220 is fixed by a spacer such as a pressboard that is not shown.

In the present embodiment, each of the plurality of third electromagnetic steel plates 30 has a strip shape and has an insulating layer formed on each of its both main surfaces. The plurality of third electromagnetic steel plates 30 are welded and fixed onto retaining plate 31 in the state where these third electromagnetic steel plates 30 are sandwiched on both sides in the stacking direction thereof. Thereby, second magnetic shield 240 is integrally held.

Retaining plate 31 is formed of non-magnetic metal and located perpendicular to each of the plurality of third electromagnetic steel plates 30. Retaining plate 31 has a length that is approximately equal to the length of each of the plurality of third electromagnetic steel plates 30. Retaining plate 31 also has a width that is approximately equal to the total thickness of the plurality of third electromagnetic steel plates 30 that form second magnetic shield 240. Retaining plate 31 is in contact with the side surface of first magnetic shield 230 in the stacking direction of second electromagnetic steel plates 20. In addition, the length of retaining plate 31 may be shorter than the length of each of the plurality of third electromagnetic steel plates 30.

It is preferable that the length of second magnetic shield 240 is equal to the length of first magnetic shield 230. It is preferable that the width of second magnetic shield 240 in the stacking direction of third electromagnetic steel plates 30 is equal to the thickness of first magnetic shield 230. In this case, two second magnetic shields 240 can entirely cover both side surfaces of first magnetic shield 230 in the stacking direction of second electromagnetic steel plates 20.

It is preferable that first magnetic shield 230 and second magnetic shield 240 entirely cover main surface 221*m* of shaft portion 221. In other words, it is preferable that the total of the width of first magnetic shield 230 and the thickness of two second magnetic shields 240 in the stacking direction of second electromagnetic steel plates 20 is equal to the width of main surface 221*m* of shaft portion 221.

Since stationary induction apparatus 200 according to the present embodiment includes first magnetic shield 230 and second magnetic shield 240, it becomes possible to suppress entry of leakage flux 2 from winding 210 in the direction orthogonal to the main surface of first electromagnetic steel plates 10 that form shaft portion 221 of iron core 220, as shown in FIG. 4. Thereby, occurrence of eddy current loss in shaft portion 221 can be suppressed.

Furthermore, second magnetic shield 240 can suppress entry of leakage flux 2 from winding 210 through the main surface of second electromagnetic steel plate 20 that is located at each of both ends of first magnetic shield 230 in the stacking direction of second electromagnetic steel plates 20. Thereby, occurrence of eddy current loss in first magnetic shield 230 can be suppressed.

In the present embodiment, second magnetic shield 240 entirely covers each of both side surfaces of first magnetic shield 230 in the stacking direction of second electromagnetic steel plates 20, so that occurrence of eddy current loss in first magnetic shield 230 can be effectively suppressed.

As described above, the eddy current loss occurring in shaft portion 221 and first magnetic shield 230 is reduced, so that the efficiency in stationary induction apparatus 200 can be improved.

Furthermore, in the present embodiment, first magnetic shield 230 and second magnetic shield 240 are longer in the axis direction of shaft portion 221 than the region where winding 210 is located, and thus, protrudes in the axis direction of shaft portion 221 to the outside beyond each of both ends of the region where winding 210 is located. Thereby, it becomes possible to suppress entry of leakage flux 2 from winding 210 through the main surface of iron core 220 located at each of both ends of shaft portion 221 in the axis direction of shaft portion 221. Consequently, occurrence of eddy current loss in iron core 220 can be further suppressed.

In addition, the space between winding 210 and iron core 220 serves as a flow passage of the cooling medium for cooling winding 210 and iron core 220. The eddy current loss occurring in iron core 220 and first magnetic shield 230 is reduced, so that local heating can be suppressed from occurring in iron core 220 and first magnetic shield 230. Accordingly, the required flow rate of the cooling medium can be reduced, thereby reducing the space between winding 210 and iron core 220, so that the outer diameter of winding 210 can be reduced.

Since the entire length of winding 210 can be shortened by reducing the outer diameter of winding 210, it becomes possible to reduce the manufacturing cost of winding 210 and also reduce the Joule heat loss in winding 210. Also, the outer diameter of winding 210 is reduced, to thereby reduce the size of the tank (not shown), so that stationary induction apparatus 200 can be reduced in size.

In the following, the stationary induction apparatus according to the third embodiment of the present invention will be described. It is to be noted that stationary induction apparatus 300 according to the present embodiment is mainly different from the stationary induction apparatus according to the second embodiment in that the shaft portion and the first magnetic shield are reduced in width in a stepwise manner. Accordingly, other configurations will not be repeated.

Third Embodiment

Figure 5:
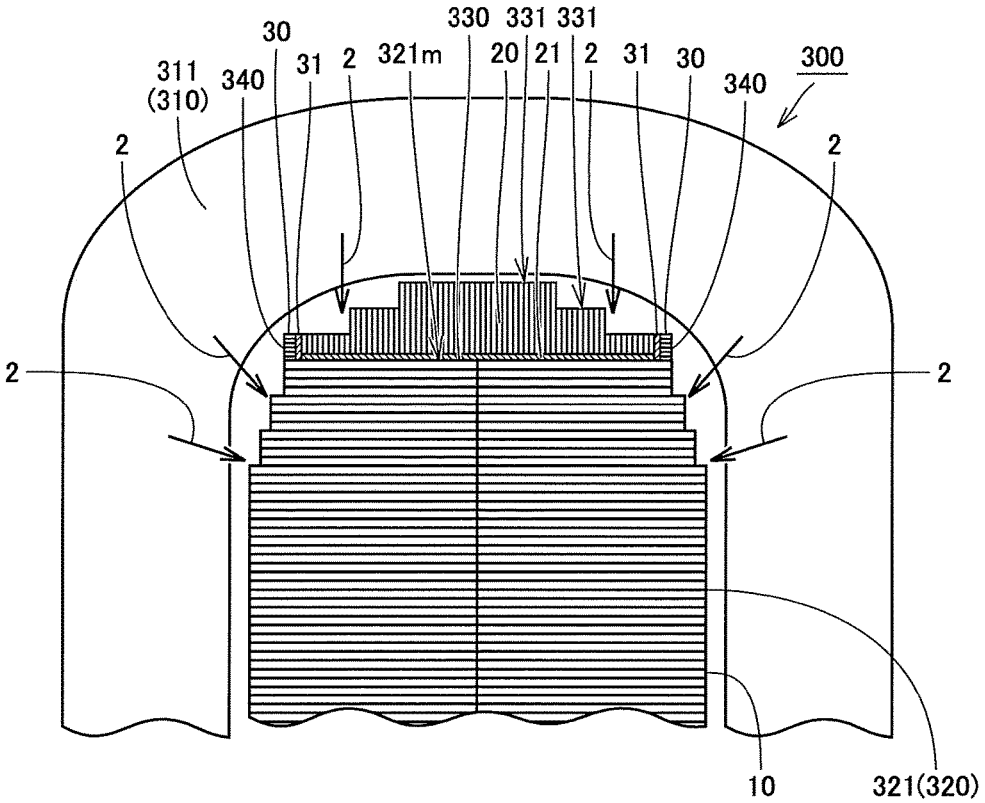
FIG. 5 is a cross-sectional view showing the configuration of a stationary induction apparatus according to the third embodiment of the present invention.

FIG. 5 is a cross-sectional view showing the configuration of a stationary induction apparatus according to the third embodiment of the present invention. FIG. 5 is shown in the same cross-sectional view as that in FIG. 4. Although FIG. 5 shows only one side of first electromagnetic steel plates 10 in the stacking direction, first magnetic shield 330 and second magnetic shield 340 are similarly arranged also on the other side of first electromagnetic steel plates 10 in the stacking direction thereof.

As shown in FIG. 5, stationary induction apparatus 300 according to the third embodiment of the present invention is a shell-type transformer. Stationary induction apparatus 300 includes a winding 310, an iron core 320, a first magnetic shield 330, and a second magnetic shield 340. In the present embodiment, shaft portion 321 has a width that reduces in a stepwise manner toward winding 310 in the stacking direction of first electromagnetic steel plates 10.

First magnetic shield 330 is configured by stacking a plurality of second electromagnetic steel plates 20, which extend in the axis direction of shaft portion 321, in the direction orthogonal to the stacking direction of first electromagnetic steel plates 10. First magnetic shield 330 is arranged along main surface 321*m* between shaft portion 321 and winding 310.

In the present embodiment, first magnetic shield 330 has two narrowed portions 331. In each of two narrowed portions 331, second electromagnetic steel plates 20 are reduced in width in the stacking direction in a stepwise manner toward winding 310 in the stacking direction of first electromagnetic steel plates 10. However, the number of narrowed portions 331 is not limited to two, but may be at least one. The position of first magnetic shield 330 relative to winding 310 and iron core 320 is fixed by a spacer such as a pressboard that is not shown.

In the present embodiment, each of the plurality of second electromagnetic steel plates 20 has a strip shape and has an insulating layer formed on each of its both main surfaces. Three types of second electromagnetic steel plates 20 having different widths are used. The plurality of second electromagnetic steel plates 20 are welded and fixed onto retaining plate 21 in the state where these second electromagnetic steel plates 20 are sandwiched on both sides in the stacking direction thereof. Thereby, first magnetic shield 330 is integrally held.

Retaining plate 21 is formed of non-magnetic metal and located perpendicular to each of the plurality of second electromagnetic steel plates 20. Retaining plate 21 has a length that is approximately equal to the length of each of the plurality of second electromagnetic steel plates 20. Retaining plate 21 also has a width that is approximately equal to the total thickness of the plurality of second electromagnetic steel plates 20 that form first magnetic shield 330. Retaining plate 21 is in contact with main surface 321*m* of shaft portion 221. In addition, the length of retaining plate 21 may be shorter than the length of each of the plurality of second electromagnetic steel plates 20.

Second magnetic shield 340 is configured by stacking a plurality of third electromagnetic steel plates 30, which extend in the axis direction of shaft portion 321, in the direction orthogonal to the stacking direction of second electromagnetic steel plates 20. Second magnetic shield 340 is arranged along main surface 221*m* of shaft portion 321 between shaft portion 321 and winding 310, and also arranged on each of both sides of first magnetic shield 330 so as to sandwich first magnetic shield 330 in the stacking direction of second electromagnetic steel plates 20. The position of second magnetic shield 340 relative to winding 310 and iron core 320 is fixed by a spacer such as a pressboard that is not shown.

In the present embodiment, each of the plurality of third electromagnetic steel plates 30 has a strip shape and has an insulating layer formed on each of its both main surfaces. The plurality of third electromagnetic steel plates 30 are welded and fixed onto retaining plate 31 in the state where these third electromagnetic steel plates 30 are sandwiched on both sides in the stacking direction thereof. Thereby, second magnetic shield 340 is integrally held.

Retaining plate 31 is formed of non-magnetic metal and located perpendicular to each of the plurality of third electromagnetic steel plates 30. Retaining plate 31 has a length that is approximately equal to the length of each of the plurality of third electromagnetic steel plates 30. Retaining plate 31 also has a width that is approximately equal to the total thickness of the plurality of third electromagnetic steel plates 30 that form second magnetic shield 340. Retaining plate 31 is in contact with each of the side surfaces of first magnetic shield 330 in the stacking direction of second electromagnetic steel plates 20. In addition, the length of retaining plate 31 may be shorter than the length of each of the plurality of third electromagnetic steel plates 30.

It is preferable that the length of second magnetic shield 340 is equal to the length of first magnetic shield 330. It is preferable that the width of second magnetic shield 340 in the stacking direction of third electromagnetic steel plates 30 is equal to the thickness of each end of first magnetic shield 330 in the stacking direction of second electromagnetic steel plates 20. In this case, two second magnetic shields 340 can entirely cover both side surfaces of first magnetic shield 330 in the stacking direction of second electromagnetic steel plates 20.

It is preferable that first magnetic shield 330 and second magnetic shield 340 entirely cover main surface 321*m* of shaft portion 321. In other words, it is preferable that the total of the width of first magnetic shield 330 and the thickness of two second magnetic shields 340 in the stacking direction of second electromagnetic steel plates 20 is equal to the width of main surface 321*m* of shaft portion 321.

Stationary induction apparatus 300 according to the present embodiment includes first magnetic shield 330 and second magnetic shield 340. Accordingly, it becomes possible to suppress entry of leakage flux 2 from winding 310 in the direction orthogonal to the main surface of first electromagnetic steel plates 10 that form shaft portion 321 of iron core 320, as shown in FIG. 5. Thereby, occurrence of eddy current loss in shaft portion 321 can be suppressed.

Furthermore, second magnetic shield 340 can suppress entry of leakage flux 2 from winding 310 through the main surface of second electromagnetic steel plate 20 that is located at each of both ends of first magnetic shield 330 in the stacking direction of second electromagnetic steel plates 20. Thereby, occurrence of eddy current loss in first magnetic shield 330 can be suppressed.

In the present embodiment, second magnetic shield 340 entirely covers each of both side surfaces of first magnetic shield 330 in the stacking direction of second electromagnetic steel plates 20, so that occurrence of eddy current loss in first magnetic shield 330 can be effectively suppressed.

As described above, the eddy current loss occurring in shaft portion 321 and first magnetic shield 330 is reduced, so that the efficiency in stationary induction apparatus 300 can be improved.

Furthermore, each of iron core 320 and first magnetic shield 330 is configured to have a width that is reduced in a stepwise manner toward winding 310 in the stacking direction of first electromagnetic steel plates 10. Accordingly, winding 310 and iron core 320 can be arranged in close proximity to each other. Thereby, the space between winding 310 and iron core 320 is reduced, so that the outer diameter of winding 310 can be reduced.

Since the entire length of winding 310 can be shortened by reducing the outer diameter of winding 310, it becomes possible to reduce the manufacturing cost of winding 310 and also reduce Joule heat loss in winding 310. Also, the outer diameter of winding 310 is reduced, to thereby reduce the size of the tank (not shown), so that stationary induction apparatus 300 can be reduced in size.

In the following, the stationary induction apparatus according to the fourth embodiment of the present invention will be described. It is to be noted that the stationary induction apparatus according to the present embodiment is different from the stationary induction apparatus according to the third embodiment only in that the second magnetic shield is further arranged on each of both sides of each narrowed portion. Thus, other configurations will not be repeated.

Fourth Embodiment

Figure 6:
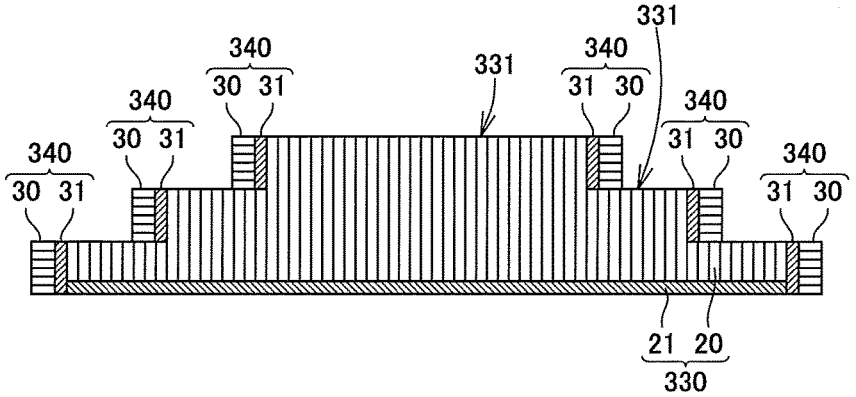
FIG. 6 is a cross-sectional view showing the configuration of a stationary induction apparatus according to the fourth embodiment of the present invention.

FIG. 6 is a cross-sectional view showing the configuration of a stationary induction apparatus according to the fourth embodiment of the present invention. FIG. 6 is shown in the same cross-sectional view as that in FIG. 5. FIG. 6 shows only first magnetic shield 330 and second magnetic shield 340.

As shown in FIG. 6, second magnetic shield 340 of the stationary induction apparatus according to the fourth embodiment of the present invention is further arranged on each of both sides of narrowed portion 331 so as to sandwich narrowed portion 331 in the stacking direction of second electromagnetic steel plates 20. In the present embodiment, first magnetic shield 330 has two narrowed portions 331. Each narrowed portion 331 is sandwiched between second magnetic shields 340. It is preferable that second magnetic shield 340 entirely covers each of both side surfaces of narrowed portion 331 in the stacking direction of second electromagnetic steel plates 20.

In the present embodiment, since each narrowed portion 331 is sandwiched between second magnetic shields 340, occurrence of eddy current loss in first magnetic shield 330 can be effectively suppressed. Furthermore, since second magnetic shield 340 entirely covers each of both side surfaces of narrowed portion 331 in the stacking direction of second electromagnetic steel plates 20, occurrence of eddy current loss in first magnetic shield 330 can be more effectively suppressed. By reducing the eddy current loss occurring in first magnetic shield 330, the efficiency in the stationary induction apparatus can be improved.

It is noted that the embodiments disclosed herein are illustrative in every respect, and do not serve as a basis for restrictive interpretation. Therefore, the technical scope of the present invention should not be interpreted by the above embodiments only, and is defined based on the description in the scope of the claims. Further, any modifications within the meaning and scope equivalent to the scope of the claims are encompassed.

REFERENCE SIGNS LIST

1, 2 leakage flux, 10 first electromagnetic steel plate, 20 second electromagnetic steel plate, 21, 31 retaining plate, 30 third electromagnetic steel plate, 100, 200, 300 stationary induction apparatus, 110, 210, 310 winding, 111, 211 high-voltage coil, 112, 212 low-voltage coil, 120, 220, 320 iron core, 121, 221, 321 shaft portion, 121*m*, 221*m*, 321*m* main surface, 130, 230, 330 first magnetic shield, 140, 240, 340 second magnetic shield, 331 narrowed portion.

The invention claimed is:

1. A stationary induction apparatus comprising:

an iron core provided with a shaft portion including a plurality of first electromagnetic steel plates that are stacked in a stacking direction, the shaft portion having a main surface located at each of both ends of the plurality of first electromagnetic steel plates in the stacking direction;

a winding wound around the shaft portion;

a first magnetic shield arranged along the main surface at least between the shaft portion and the winding, the first magnetic shield being configured by stacking a plurality of second electromagnetic steel plates in a direction orthogonal to the stacking direction of the first electromagnetic steel plates, the plurality of second electromagnetic steel plates extending in an axis direction of the shaft portion; and a second magnetic shield arranged along the main surface at least between the shaft portion and the winding, the second magnetic shield being arranged on each of both sides of the first magnetic shield so as to sandwich the first magnetic shield in a stacking direction of the second electromagnetic steel plates, the second magnetic shield being configured by stacking a plurality of third electromagnetic steel plates in a direction orthogonal to the stacking direction of the second electromagnetic steel plates, the plurality of third electromagnetic steel plates extending in the axis direction of the shaft portion, the first magnetic shield having at least one narrowed portion in which the second electromagnetic steel plates are reduced in width in the stacking direction thereof in a stepwise manner toward the winding in the stacking direction of the first electromagnetic steel plates, and the second magnetic shield being further arranged on each of both sides of the narrowed portion so as to sandwich the narrowed portion in the stacking direction of the second electromagnetic steel plates.

2. The stationary induction apparatus according to claim 1, wherein the second magnetic shield entirely covers each of both side surfaces of the first magnetic shield in the stacking direction of the second electromagnetic steel plates.

3. The stationary induction apparatus according to claim 1, wherein the second magnetic shield entirely covers each of both side surfaces of the narrowed portion in the stacking direction of the second electromagnetic steel plates.

4. The stationary induction apparatus according to claim 2, wherein the second magnetic shield entirely covers each of both side surfaces of the narrowed portion in the stacking direction of the second electromagnetic steel plates.

* * * * *